US006375441B1

(12) United States Patent
Ichizuki et al.

(10) Patent No.: US 6,375,441 B1
(45) Date of Patent: Apr. 23, 2002

(54) BACK PRESSURE GROOVE STRUCTURE OF VARIABLE DISPLACEMENT VANE PUMP

(75) Inventors: Morihito Ichizuki; Kenji Saito; Yoshinobu Yamada, all of Tochigi (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/631,732

(22) Filed: Aug. 4, 2000

(30) Foreign Application Priority Data

Aug. 20, 1999 (JP) ..... 11-233530

(51) Int. Cl.[7] ..... F04C 2/344; F04C 15/04

(52) U.S. Cl. ..... 418/30; 418/82; 418/133; 418/268; 418/269

(58) Field of Search ..... 418/82, 133, 268, 418/269, 30, 31

(56) References Cited

U.S. PATENT DOCUMENTS 4,104,010 A * 8/1978 Shibuya ..... 418/82
5,490,770 A * 2/1996 Oogushi ..... 418/82

FOREIGN PATENT DOCUMENTS

JP 6124713 7/1986
JP 1193856 4/1999

* cited by examiner

*Primary Examiner*—John J. Vrablik

(57) ABSTRACT

In the back pressure groove structure of a variable displacement vane pump comprising a rotor rotatably contained in a pump housing and having a plurality of vane grooves arranged radially and equidistantly in a circumferential direction, a cam ring is arranged in the pump housing in a movable and displaceable manner, fitted into the pump housing to form a pump chamber with an outer peripheral portion of the rotor and applied with an urging force to provide a maximum volume of the pump chamber. A side plate is contained in the pump housing in a non-rotatable manner, slidably contacting with one sides of the rotor and the cam ring and having back pressure grooves communicating with the vane grooves. A cover plate closes an opening of the pump housing, slidably contacting with other sides of the rotor and the cam ring and having a back pressure groove communicating with the vane grooves, the back pressure grooves of the side plate communicate with a high pressure side and are divided back pressure grooves obtained by dividing an annular back pressure groove into a pump suction side groove and a pump discharge side groove. The back pressure groove of the cover plate is an annular back pressure groove or a C-shaped back pressure groove obtained by closing the annular back pressure groove at one of a pump suction side portion and a pump discharge side portion into which the annular back pressure groove is virtually partitioned.

3 Claims, 9 Drawing Sheets

Prior Art

Prior Art

BACK PRESSURE GROOVE STRUCTURE OF VARIABLE DISPLACEMENT VANE PUMP

BACKGROUND OF THE INVENTION

1. Field of the Invention

The present invention relates to the back pressure groove structure of a variable displacement vane pump and particularly relates to the back pressure groove structure of a variable displacement pump intended to smoothly flow back pressure oil in back pressure grooves formed in a side plate and a cover plate, to reduce the noise and vibration of the pump.

2. Description of the Related Art

A pressure balance type vane pump has two pairs of pump suction parts and pump discharge parts, the pump suction parts facing each other and the pump discharge parts facing each other.

A variable displacement vane pump, by contrast, has a structure in which only one pair of a pump suction part and a pump discharge part is provided. Back pressure grooves formed in a side plate and a cover plate for supplying back pressure oil assisting in the ejection of vanes are constructed to correspond to the pair of the pump suction part and the pump discharge part.

That is, as shown in FIG. 11, a semicircular arc-shaped back pressure groove 028*a* supplying back pressure oil for assisting in the ejection of vanes at a pump suction side and a semicircular arc-shaped back pressure groove 028*b* supplying back pressure oil for assisting in the ejection of vanes at a pump discharge side are formed in a side plate 05. These semicircular arc-shaped back pressure grooves 028*a* and 028*b* communicate with each other by two restrictors 50 provided at both sides, respectively. The back pressure groove 028*a* communicates with a high pressure side (a pump discharge chamber) through a back pressure-side fluid channel 027. Reference symbol 018*b* denotes a suction convex groove communicating with the pump suction part and reference symbol 019*b* denotes a discharge through groove communicating with the pump discharge part.

Also, as shown in FIG. 10, a semicircular arc-shaped back pressure groove 029*a* supplying back pressure oil for assisting in the ejection of vanes at the pump suction side and a semicircular arc-shaped back pressure groove 029*b* supplying back pressure oil for assisting in the ejection of vanes at the pump discharge side are formed in a cover plate 03. These semicircular arc-shaped back pressure grooves 029*a* and 029*b* do not communicate with each other (see Japanese Patent Application Laid-Open (JP-A) No. 11-93856).

At the pump suction side, as the capacity of the pump chamber increases, vanes are attracted by a cam ring and the ejection rate of vanes increases. To compensate for the increase, the quantity of back pressure oil for assisting in the ejection of vanes tends to be increased. At the pump discharge side, as the capacity of the pump chamber decreases, the vanes are pressed by the cam ring and the ejection rate of the vanes decreases. To compensate for the decrease, the back pressure oil for assisting in the ejection of the vanes tends to be decreased.

Due to this, at the pump discharge side, the back pressure oil forced out of the back pressure groove 029*b* of the cover plate, back pressure holes 016 (see FIG. 12) of a rotor and the back pressure groove 028*b* of the side plate is induced to flow into the back pressure groove 028*a* at the pump suction side through the restrictors 050 and further into the back pressure holes 016 of the rotor at the pump suction side.

Then, as shown in FIG. 12, the back pressure oil which is flowing into the back pressure groove 028*a* at the pump suction side through the restrictors 050 collides against the back pressure oil fed into the pump suction-side back pressure groove 028*a* from the high pressure chamber (pump discharge chamber) to compensate for the increase of the ejection rate of the vanes due to the increased capacity of the pump chamber at the pump suction side.

The collision between the back pressure oil forced out of the back pressure groove 028*b* of the side plate at the pump discharge side and the back pressure oil (high pressure oil) flowing into the back pressure groove 028*a* of the side plate at the pump suction side may cause the problems of pump noise and pump vibration.

SUMMARY OF THE INVENTION

It is an object of the present invention to solve the above-stated problems of the conventional variable displacement vane pump and, in particular, to provide the back pressure groove structure of a variable displacement vane pump capable of realizing the smooth flow of back pressure oil flowing in back pressure grooves formed in a side plate and a cover plate and capable of reducing the noise and vibration of the pump.

A back pressure groove structure of a variable displacement vane pump according to the present invention comprises a rotor rotatably contained in a pump housing and having a plurality of vane grooves arranged radially and equidistantly in a circumferential direction. A cam ring is arranged in the pump housing in a movable and displaceable manner, fitted into the pump housing to form a pump chamber with an outer peripheral portion of the rotor and applied with an urging force to provide a maximum volume of the pump chamber. A side plate is contained in the pump housing in a non-rotatable manner, slidably contacting with one sides of the rotor and the cam ring and having back pressure grooves communicating with the vane grooves. A cover plate is provided, dosing an opening of the pump housing, slidably contacting with other sides of the rotor and the cam ring and having a back pressure groove communicating with the vane grooves, characterized in that the back pressure grooves of the side plate communicate with a high pressure side and are divided back pressure grooves obtained by dividing an annular back pressure groove into a pump suction side groove and a pump discharge side groove. The back pressure groove of the cover plate is an annular back pressure groove.

BRIEF DESCRIPTION OF THE DRAWINGS

The present invention will be more fully understood from the detailed description given below and from the accompanying drawings which should not be taken to be a limitation on the invention, but are for explanation and understanding only. The drawings

DESCRIPTION OF THE PREFERRED EMBODIMENTS

Description will be given hereinafter to one embodiment of the invention recited in claims 1 to 4 of the present application with reference to FIG. 1 to FIG. 9.

Figure 1:
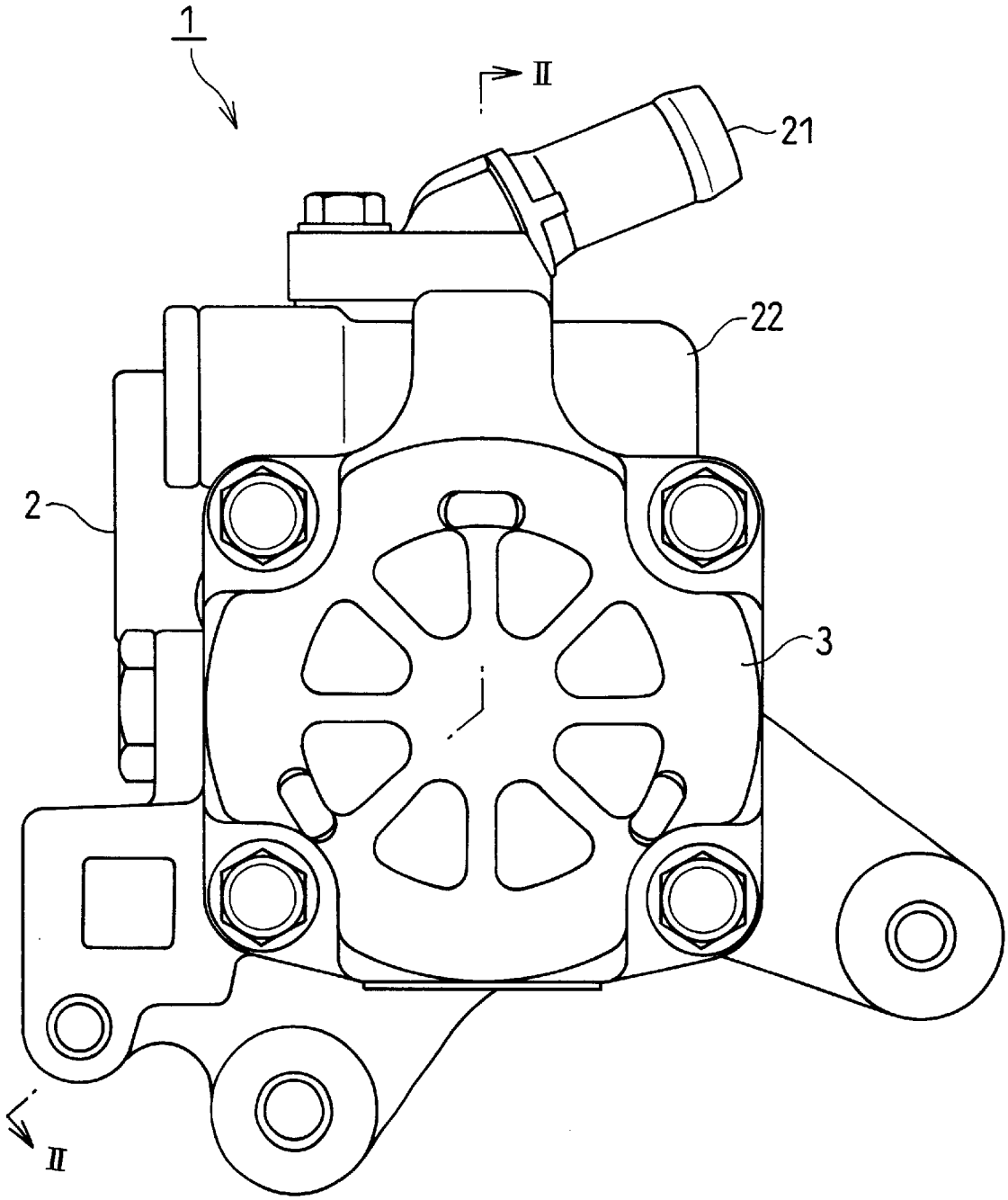
FIG. 1 is a front view of a variable displacement vane pump to which a back pressure groove structure in one embodiment of the invention.
Figure 2:
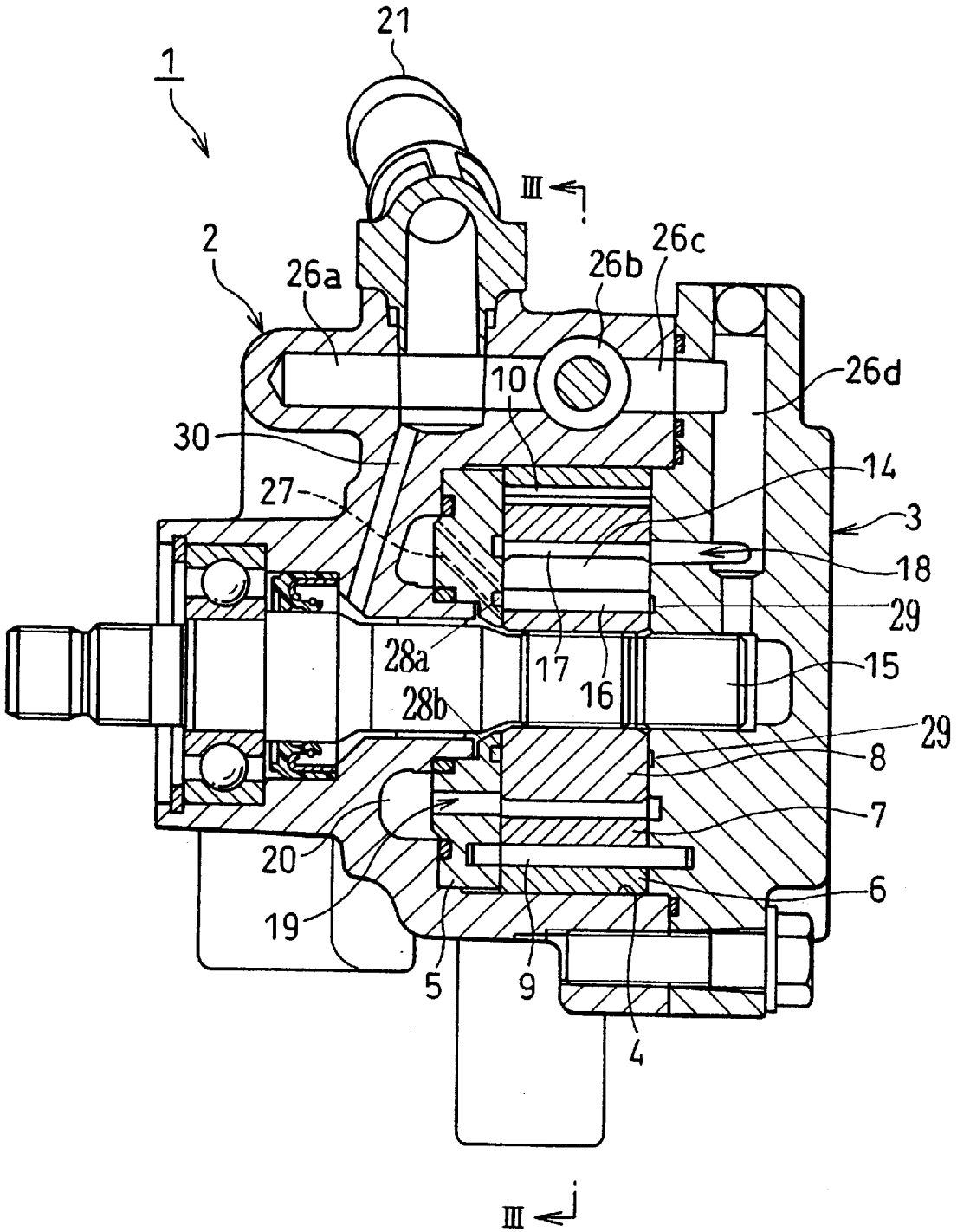
FIG. 2 is a longitudinal sectional view of the variable displacement vane pump taken a long line II—II of FIG. 1.
Figure 3:
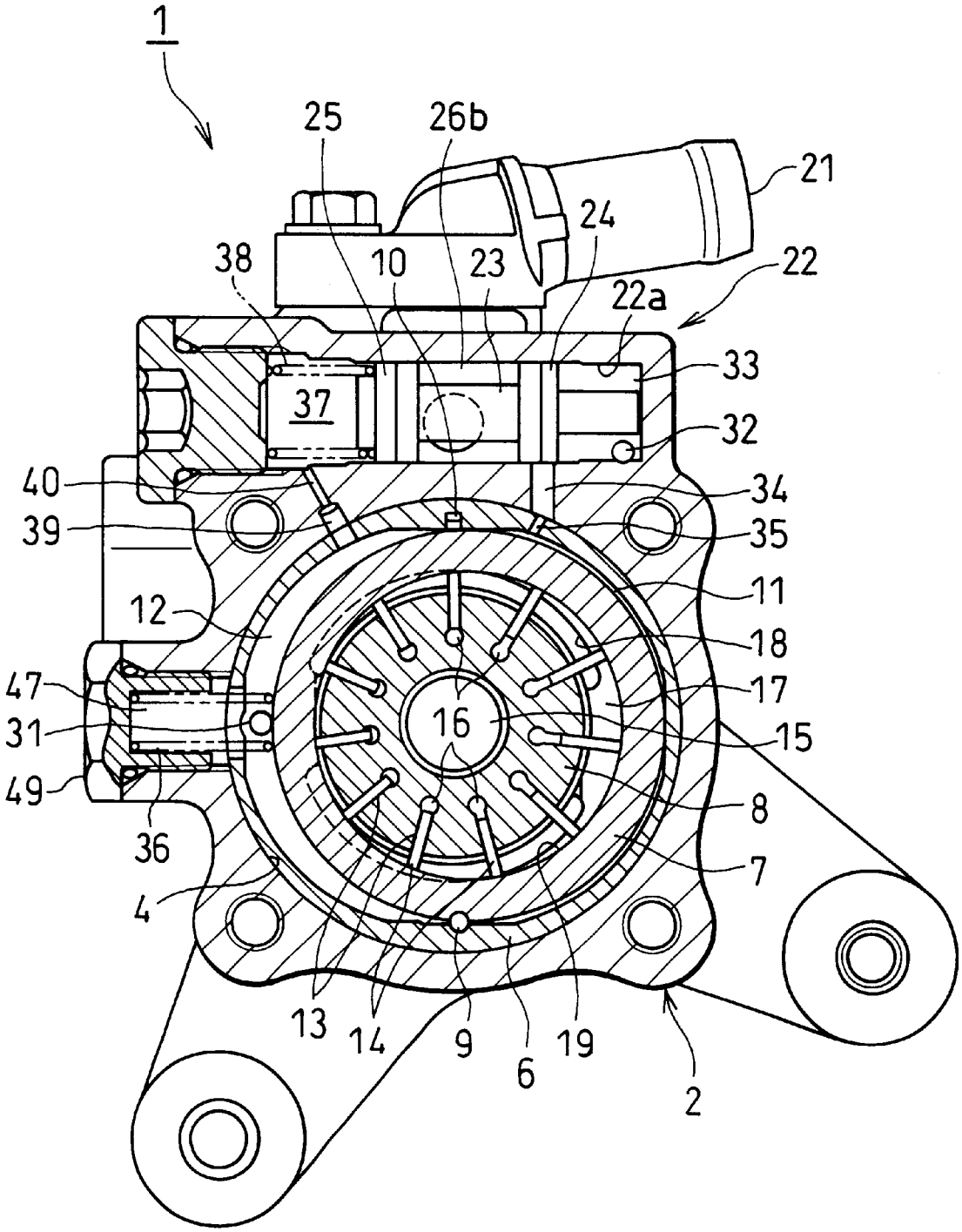
FIG. 3 is a cross-sectional view of the variable displacement vane pump taken along line III—III of FIG. 2.
Figure 4:
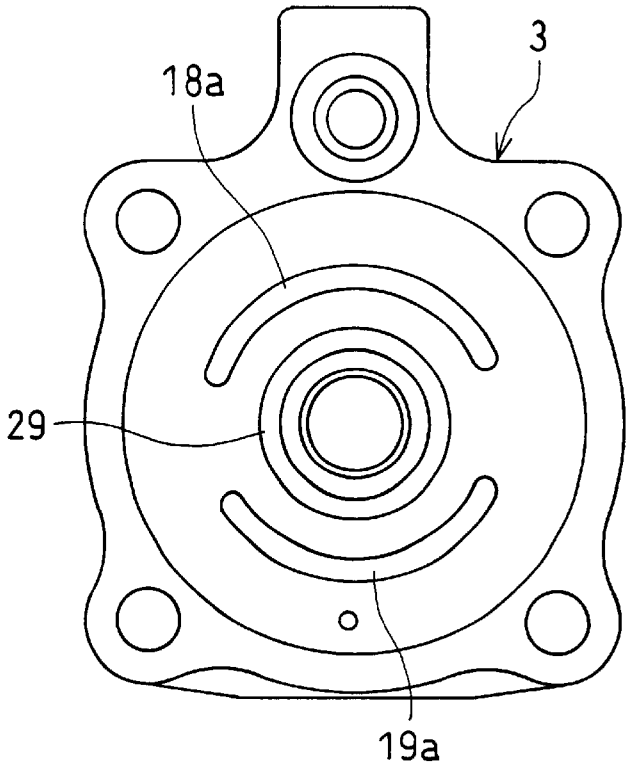
FIG. 4 is a back view of the cover plate of the variable displacement vane pump shown in FIG. 1.
Figure 5:
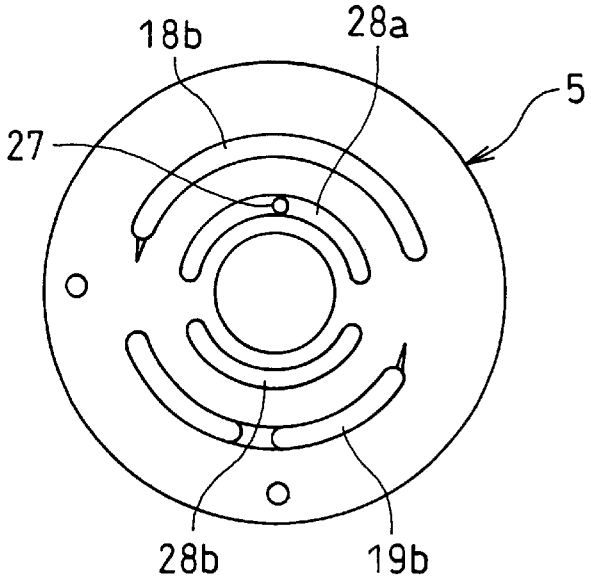
FIG. 5 is a back view of the side plate of the variable displacement vane pump shown in FIG. 1.
Figure 6:
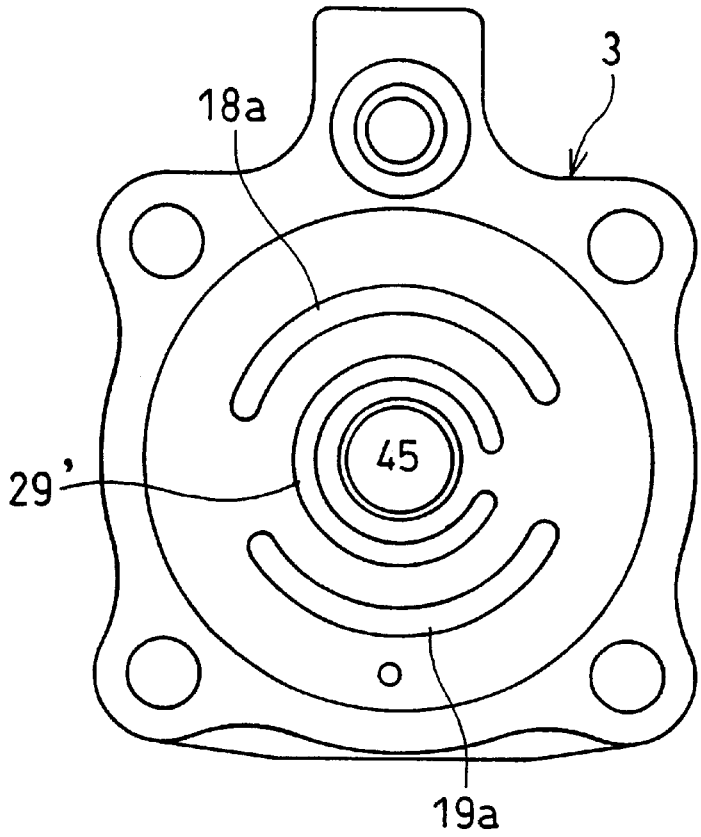
FIG. 6 shows a modification of the cover plate of FIG. 4.
Figure 7:
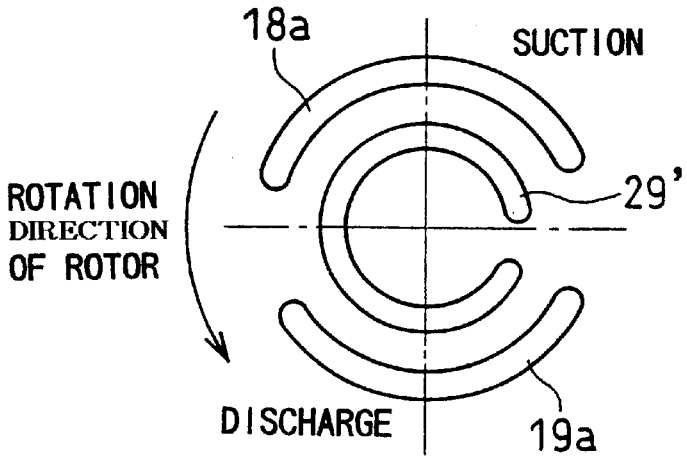
FIG. 7 is an explanatory view showing the relationship between the closed position of a C-shaped back pressure groove formed in the cover plate of FIG. 6 and the rotation direction of a rotor.
Figure 8:
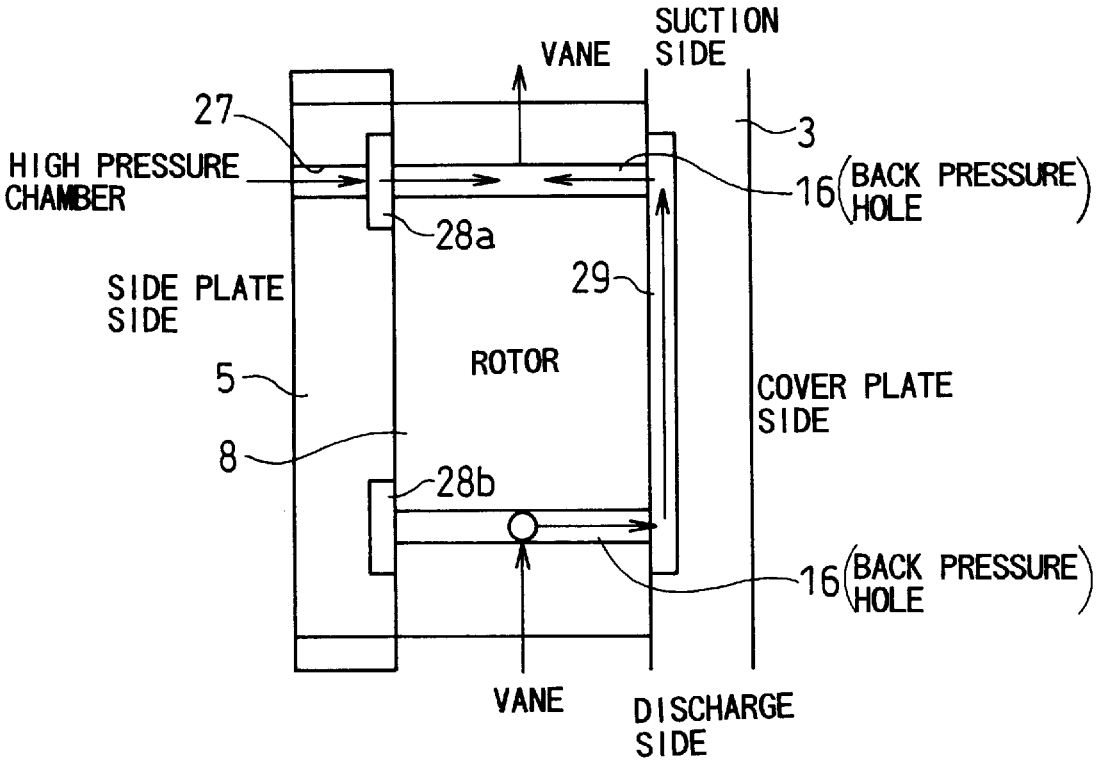
FIG. 8 is an explanatory view showing the flow of back pressure oil.
Figure 9:
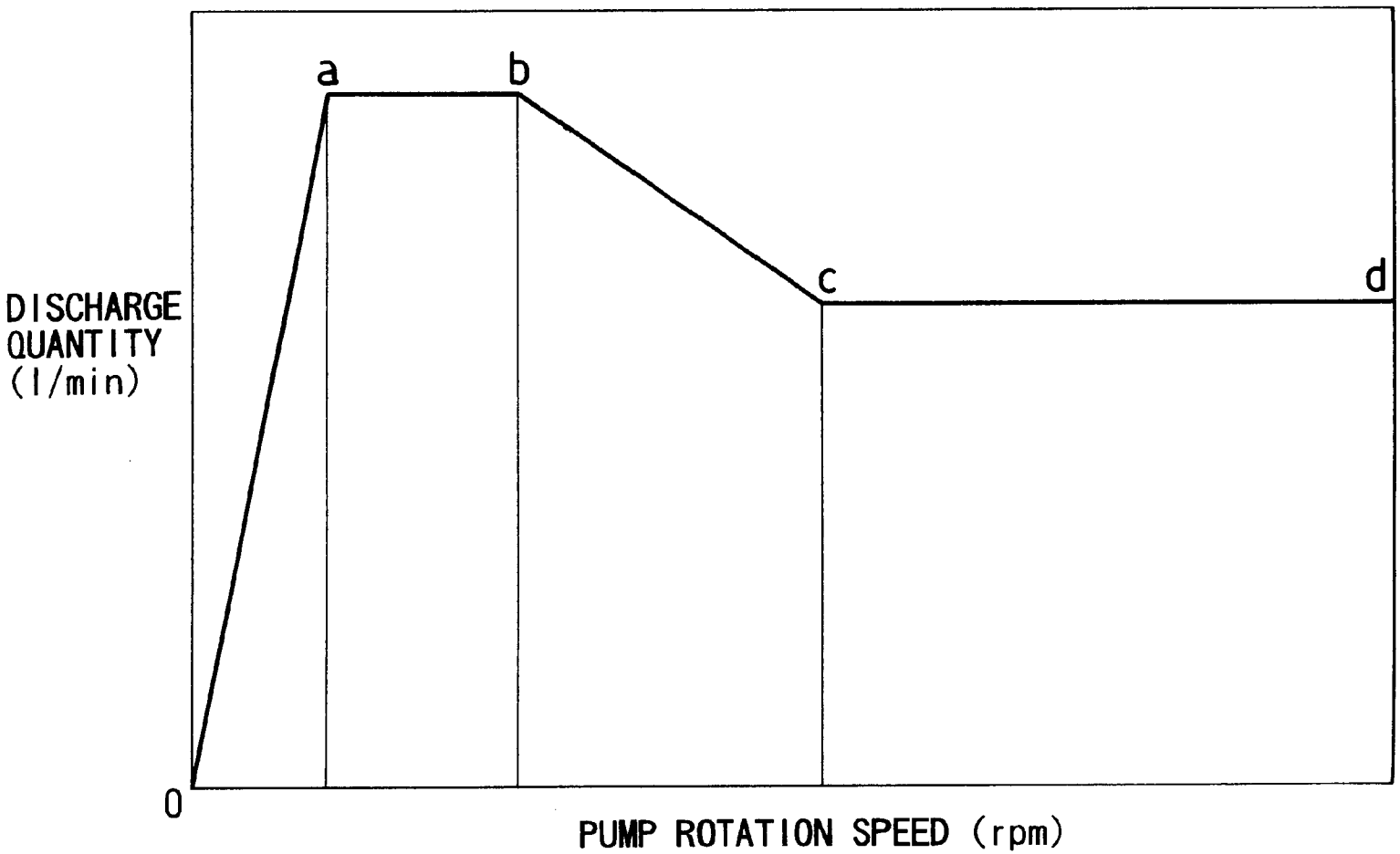
FIG. 9 is a characteristic chart of the variable displacement vane pump of FIG. 1.
Figure 10:
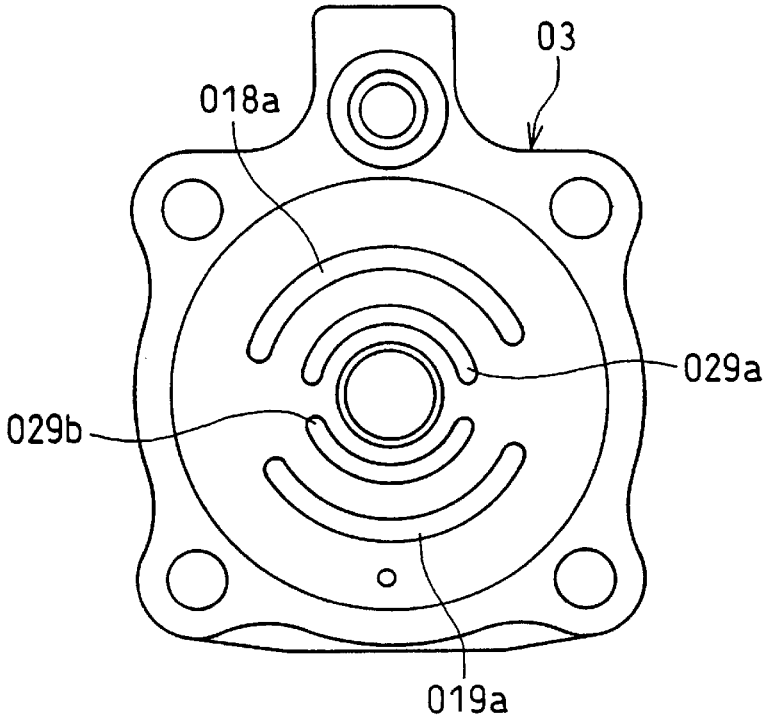
FIG. 10 is a back view of the cover plate of a conventional variable displacement vane pump, shown in the same manner as FIG. 4.
Figure 11:
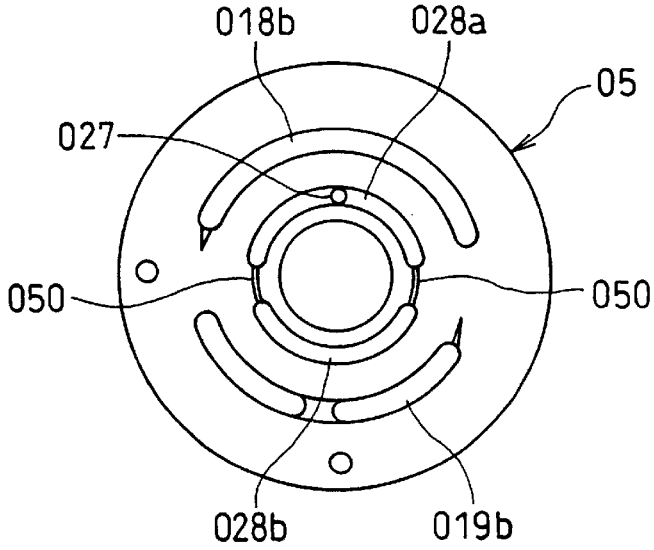
Prior Art FIG. 11
FIG. 11 is a back view of the side plate of the conventional variable displacement vane pump, shown in the same manner as FIG. 5.
Figure 12:
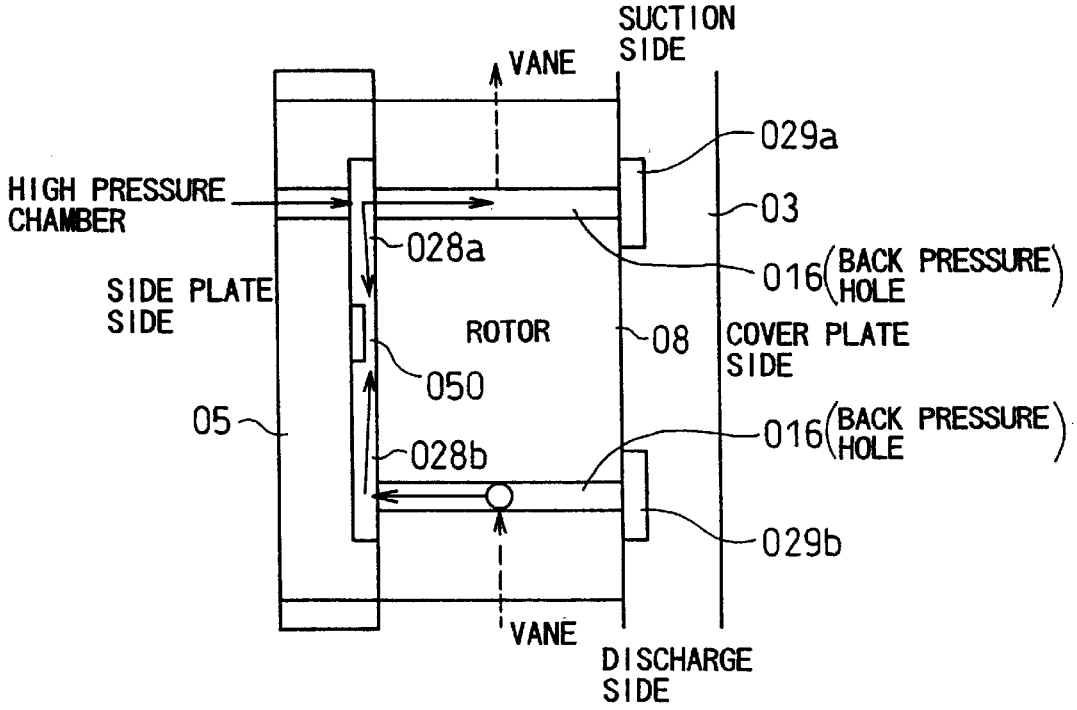
FIG. 12 is an explanatory view showing the flow of back pressure oil in the conventional variable displacement vane pump.

FIG. 1 is a front view of a variable displacement vane pump to which a back pressure groove structure in this embodiment is applied FIG. 2 is a longitudinal sectional view thereof taken along line II—II of FIG. 1. FIG. 3 is a cross-sectional view thereof taken along line III—III of FIG. 2. FIG. 4 is a back view of the cover plate of the variable displacement vane pump shown in FIG. 1. FIG. 5 is a back view of the side plate thereof. FIG. 6 shows a modification of the cover plate of FIG. 4. FIG. 7 is an explanatory view showing the relationship between the dosed position of a C-shaped back pressure groove formed in the cover plate and the rotation direction of a rotor. FIG. 8 is an explanatory view showing the flow of back pressure oil. FIG. 9 is a characteristic chart of the variable displacement vane pump of FIG. 1.

As shown in FIGS. 1 to 3, in the variable displacement pump 1 to which the back pressure groove structure of the present invention is applied, the front surface opening (facing right in FIG. 2) of a pump housing 2 which is a pump main body, is covered with a cover plate 3. A side plate 5, an outer case 6, a cam ring 7 and a rotor 8 constituting a pump cartridge are contained in a pump cartridge container space 4 in the pump housing 2 covered with the cover plate 3.

The side plate 5 is inserted into the bottom of the container space 4, the outer case 6 is inserted thereinto above the side plate 5 and the cam ring 7 is rockably contained in the outer case 6 with a seal pin 9 used as a pivotal support. One end of the seal pin 9 is inserted into a pin receiving hole formed in the side plate 5 and the other end thereof is inserted into and fixed to a pin receiving hole formed in the cover plate 3.

A seal part 10 sealing a sliding part between the inner peripheral surface of the outer case 6 and the outer peripheral surface of the cam ring 7 is provided at a position almost symmetric, about the axial center of the pump, to a position at which the cam ring 7 is pivotally supported by the seal pin 9. The seal pin 9 and the seal part 10 partition the space between the inner peripheral surface of the outer case 6 and the outer peripheral surface of the cam ring 7 into the first fluid pressure chamber 11 and the second fluid pressure chamber 12. While FIG. 3 shows that the first fluid chamber 11 is separated into two chambers, these two chambers are communicated with each other by a groove formed on the slide-contact surface of the side plate 5.

The cam ring 7 is urged to always rock toward the fluid pressure chamber 11 side by a spring 36 contained in both the second fluid pressure chamber 12 and a chamber 47 communicating with the second fluid pressure chamber 12. The chamber 47 is dosed by a screw plug 49.

The rotor 8 is contained in the cam ring 7. As shown in FIG. 3, a plurality of vane grooves 13 are formed radially and equidistantly in a circumferential direction in the rotor 8. Vanes 14 provided in the respective vane groove 13 slidably reciprocate in the respective vane grooves 13 along the cam face of the cam ring 7 when the rotor 8 is driven to be rotated by a pump drive shaft 15. Each of the vanes 14 is always urged toward the cam face of the cam ring 7 by pump discharge pressure supplied to a back pressure hole 16 formed in the rotor 8 along the axial direction of the rotor 8.

In this way, the respective vanes 14 are always urged against the cam face of the cam ring 7, whereby a pump chamber 17 formed to be surrounded by the adjacent two vanes 14, the cam face of the cam ring 7, the outer peripheral surface of the rotor 8, the side plate 5 and the cover plate 3 acts as a pump, and pressurizes operating oil sucked from the suction part 18 so that pressurized oil is discharged to a discharge chamber 20 through the discharge part 19.

As shown in FIGS. 4 and 5, the suction part 18 consists of a suction through groove 18*a* as a suction groove formed in the cover plate 3 and a suction concave groove 18*b* as a suction groove formed in the side plate 5. As shown in FIGS. 4 and 5, the discharge part 19 consists of a discharge concave groove 19*a* as a discharge groove formed in the cover plate 3 and a discharge through groove 19*b* as a discharge groove formed in the side plate 5. The suction through groove 18*a* and the discharge through groove 19*b* penetrate into the cover plate 3 and the side plate 5 in the wall thickness direction, respectively.

The suction through groove 18*a* formed in the cover plate 3 and the suction concave groove 18*b* formed in the side plate 5 communicate with each other and confront the pump chamber 17 in which a suction step is conducted. Further, the discharge concave groove 19*a* formed in the cover plate 3 and the discharge through groove 19*b* formed in the side plate 5 communicate with each other and confront the pump chamber 17 in which a discharge step is conducted.

Only one pair of the suction through groove 18*a* and the discharge concave groove 19*a* at the cover plate side is provided in the cover plate 3 and only one pair of the suction concave groove 18*b* and the discharge through groove 19*b* at the side plate side is provided in the side plate 5.

Operating oil passes through a suction-side fluid channel 26*a* formed from a pump suction port 21 into the pump housing 2, an annular chamber 26*b* held between two lands 24 and 25 of a spool 23 contained in a spool containing hole 22*a* of a control valve 22, a suction-side fluid channel 26*c* formed in the pump housing 2 and a suction-side fluid channel 26*d* formed in the cover plate 3, and is introduced to the suction part 18 stated above.

Operating oil pressurized by the pumping action of the pump chamber 17 passes through the discharge part 19 and then flows into the discharge chamber 20 as already stated above. Thereafter, the operating oil is fed to various equipment employing fluid pressure such as a power steering device of a vehicle.

As shown in FIGS. 2 to 5 and 8, part of the operating oil thus pressurized passes through a back pressure side fluid channel 27 formed from the discharge chamber sigh pressure chamber) 20 to the side plate 5 and flows into a back pressure groove 28*a* formed out of one semicircular arc-shaped groove formed in the side plate 5. Thereafter, in FIG. 3, part of the operating oil is introduced into the back pressure hole 16 of the rotor 8 at the upper half pump suction side and then into the back pressure hole 16 of the rotor 8 at the lower half pump discharge side by way of a back pressure groove 29 consisting of an annular groove formed in the cover plate 3. Finally, the operating oil reaches a back pressure groove 28*b* formed out of the other semicircular arc-shaped groove formed in the side plate 5.

The back pressure side fluid channel 27, one semicircular arc-shaped back pressure groove 28*a,* the upper half back pressure hole 16, the annular back pressure groove 29, the lower half back pressure hole 16 and the other semicircular back pressure groove 28*b* constitute a dead-end channel for operating oil as a whole. The back pressure oil flled in the dead-end channel urges the respective vanes 14 against the cam face of the cam ring 7. The back pressure oil together with part of the operating oil in the discharge part 19 also reaches the side-contact part between the cover plate 3 and the rotor 8 and that between the side plate 5 and the rotor 8 through the gap between the cover plate 3 and the rotor 8 and that between the side plate 5 and the rotor 8, thereby lubricating these slide-contact parts.

Finally, the operating oil effuse into and lubricates the bearing part of a drive shaft 15 and circulates toward the pump suction side through a lubricating oil return channel 30 and the suction side fluid channel 26*d* formed in the pump housing 2.

Further, the pressure of the pressurized operating oil is reduced after passing through a variable orifice 31 (see FIG. 3) formed from the discharge chamber 20 to the side plate 5, and the pressure-reduced operating oil is introduced into the second fluid pressure chamber 12. The pressurized operating oil at the upstream side of the variable orifice 31 passes a fluid channel, not shown, formed in the pump housing 2 and an opening 32 on the end portion of the channel and flows into the first valve chamber (high pressure side) 33 defined by one land 24 of the spool 23 of the control valve 22 by way of the opening 32 on the end portion of the channel.

The pressurized operating pressure flowing into the first valve chamber 33 flows into the fluid channel 34 formed in the pump housing 2 when the land 24 opens the channel 34. Thereafter, the operating pressure is introduced into the first fluid pressure chamber 11 after the pressure of the oil is reduced while passing through an orifice 35 formed on the outer case 6.

The cam ring 7 rocks leftward about the seal pin 9 against the urging force of the spring 36 in FIG. 3 due to the difference between the pressure of the operating oil introduced into the first fluid chamber 11 and that introduced into the second fluid pressure chamber 12.

Then, the side surface of the cam ring 7 contacts with the side plate 5 and gradually blocks the variable orifice 31, so that the pressure of the operating oil within the second fluid pressure chamber 12 is further reduced and the cam ring 7 further rocks leftward about the seal pin 9. The cam ring 7 stops at a position at which the pressure of the operating oil in the first fluid pressure chamber 11 is balanced with a resultant force between the pressure of the operating oil in the second fluid chamber 12 and the urging force of the spring 36.

The pressure of the operating oil introduced into the first fluid pressure chamber 11 is controlled by the control valve 22 as follows.

In the second valve chamber (low pressure side) 37 defined by the other land 25 of the spool 23 of the control valve 22, a spring 38 is provided in a compressed state so that the spool 23 is always urged in the direction of the first valve chamber 33.

The second valve chamber 37 communicates with the second fluid pressure chamber 12 through an orifice 40 formed in the pump housing 2 and a fluid chamber 39 formed in both the pump housing 2 and the outer case 6. The orifice 40 smoothes the pulsation of the pressure of the operating oil flowing into the second fluid pressure chamber 12 and introduces the pulsation-smoothed operating pressure into the second valve chamber 37.

On the other hand, the pressurized operating oil at the upstream side of the variable orifice 31 flows into the first valve chamber 33. Due to this, the spool 23 moves to a position at which the pressure of the pressurized operating oil is balanced with the resultant force between the urging force of the spring 38 in the second valve chamber 37 and the reduced operating oil pressure, and is then stopped. In this way, the opening rate of the fluid channel 34 is controlled and so is the pressure of the operating oil introduced into the first fluid pressure chamber 11 by way of the fluid channel 34 and the orifice 35.

Consequently, if the pump is started and the rotation speed of the pump gradually increases (in an idling state), then the discharge quantity of the pump gradually increases and the pressure difference before and after the variable orifice 31 grows. Then, the pressure of the operating oil in the first valve chamber 33 increases, thereby moving the spool 23 leftward in FIG. 3 and increasing the opening rate the fluid channel 34.

Then, the pressure of the operating oil introduced into the first fluid pressure chamber 11 by way of the fluid channel 34 and the orifice 35 gradually increases and is finally balanced with the resultant force between the pressure of the operating oil in the second fluid chamber 12 and the urging force of the spring 36.

During that time, the cam spring 7 remains resting at the position shown in FIG. 3, the deviation of the cam spring 7 from the rotor 8 becomes a maximum and the discharge quantity of the pump becomes a maximum. Accordingly, as the rotation speed of the pump increases as stated above, the discharge quantity of the pump greatly increases (see line 0-a of FIG. 9).

If the rotation speed of he pump increases from that in the idling state of the vehicle to that in low-speed state, the pressure difference between before and after the variable orifice 31 further increases and the pressure of the operating oil within the first fluid pressure chamber 11 surpasses the resulting force between the pressure of the operating oil within the second fluid pressure chamber 12 and the urging force of the spring 36. The cam ring 7 is, therefore, pressed by the pressure of the operating oil in the first fluid pressure chamber 11 and gradually rocked leftward in FIG. 3. The deviation of the cam ring 7 from the rotor 8, the area of the suction part 18 confronting the pump chamber 17 and the area of the discharge part 19 confronting the pump chamber 17 gradually decrease, while the discharge quantity of the pump is kept almost at a constant high level (see line a-b of FIG. 9).

When the rotation speed of the pump further increases to that in the intermediate and high speed states of the vehicle, the pressure difference between before and after the variable orifice 31 further increases. Then the cam ring 7 is pressed by the pressure of the operating oil within the first fluid pressure chamber 11 and further rocks leftward. As a result, the deviation of the cam ring 7 from the rotor 8, the area of the suction part 18 confronting the pump chamber 17 and the area of the discharge part 19 confronting the pump chamber 17 decrease, so that the discharge quantity of the pump gradually decreases (see line b-c of FIG. 9).

During that time, the variable orifice 31 is gradually closed due to the leftward rocking of the cam ring 7 but the minimum opening area of the orifice 31 is maintained and the rocking of the cam ring 7 leftward is then stopped.

Therefore, even if the rotation speed of the pump further increases, the cam ring 7 does not rock further leftward. Thus, the deviation of the cam ring 7 from the rotor 8 is kept to a constant minimum level and the discharge quantity of the pump is kept almost at a constant low level (see line c-d of FIG. 9).

As can be seen from the above, the variable vane pump 1 in this embodiment can obtain pump discharge quantity characteristics (0-a-b-c-d) shown in FIG. 9 since the cam ring 7 moves so as to decrease the deviation of the cam ring 7 from the rotor 8 according to the increase of the rotation speed of the pump 1.

In this embodiment, the back pressure grooves formed in the side plate 5 consist of the back pressure groove 28*a* formed out of a semicircular arc-shaped groove and the back pressure groove 28*b* formed out of a semicircular arc-shaped groove as already stated above. Further, the back pressure groove formed in the cover plate 3 is constituted as the back pressure groove 29 formed out of an annular groove as already stated above. The back pressure groove formed in the cover plate 3 should not be limited to this structure and may be modified to, for example, a C-shaped back pressure groove 29' shown in FIG. 6.

The C-shaped back pre sure groove 29' is dosed at one of a pump suction side and a pump discharge side into which the annular back pressure groove 29 shown in FIG. 4 is virtually partitioned. The side is preferably a side at which a pump discharge step is completed and a pump suction step starts as clearly shown in FIG. 7.

If the one side is selected in this way, the rotation direction of the rotor 8 becomes counterclockwise in FIG. 7. Conversely, at the pump discharge side, since the volume of the pump chamber decreases, the vanes 14 are pressed by the cam ring 7 and the ejection rate of the vanes 14 decreases. As a result, the back pressure oil forced out of the discharge-side semicircular arc-shaped back pressure groove 28*b* of the side plate 5, the back pressure hole 16 of the rotor 8 at the pump discharge side and the discharge-side back pressure groove of the cover plate 3 (the lower half of the C-shaped back pressure groove 29'), flows clockwise to circulate the continuous portion of C-shape groove. Consequently, the rotation direction of the rotor 8 becomes opposite to the flow direction of the back pressure oil thus forced out and back pressure oil flow energy is, therefore, effectively offset by the friction loss between the operating oil and the rotor 8, thereby making it possible to reduce the occurrence of the noise and vibration of the pump accordingly.

In this embodiment constituted as stated above, the back pressure groove structure of the variable vane pump 1 can exhibit the following advantages.

In the back pressure groove structure of a variable displacement vane pump 1 comprising a rotor 8 rotatably contained in a pump housing 2 and having a plurality of vane grooves 13 arranged radially and equidistantly in a circumferential direction, a cam ring 7 is arranged in the pump housing 2 in a movable and displaceable manner, and is fitted into the pump housing 2 to form a pump chamber 17 with an outer peripheral portion of the rotor 8 and applied with an urging force to provide a maximum volume of the pump chamber 17. A side plate 5 is contained in the pump housing 2 in a non-rotatable manner, slidably contacting with one sides of the rotor 8 and the cam ring 7 and having back pressure grooves communicating with the vane grooves 13. A cover plate 3 close an opening of the pump housing 2, slidably contacting with other sides of the rotor 8 and the cam ring 7 and having a back pressure groove communicating with the vane grooves 13, the back pressure grooves of the side plate 5 communicate with a high pressure pump discharge chamber 20 side and are divided back pressure grooves (semicircular arc-shaped back pressure grooves 28*a* and 28*b*) obtained by dividing an annular back pressure groove into a pump suction side groove and a pump discharge side groove. The back pressure groove of the cover plate is an annular back pressure groove 29.

As a result, at the pump discharge side, as the volume of the pump chamber decreases, the vanes 14 are pressed by the cam ring 7 and the ejection rate of the vanes 14 decreases. Thus, the back pressure oil forced out of the discharge-side semicircular arc-shaped back pressure groove 28*b* of the side plate 5, the pump suction-side back pressure hole 16 of the rotor 8 and the discharge-side back pressure groove of the cover plate 3 (the lower half of the annular back pressure groove 29), is induced to flow into the suction-side back pressure groove (the upper half of the annular back pressure groove 29) of the cover plate 3 annularly communicating with the discharge-side back pressure groove (the lower half of the annular back pressure groove 29) of the cover plate 3 and further into the pump suction-side back pressure hole 16 of the rotor 8. Thus, this back pressure oil is attracted by the cam ring 7 as a result of the increased volume of the pump chamber and the ejection rate of the vanes 14 increases at the pump suction side, whereby the back pressure oil does not collide against the bad pressure oil fed from the pump discharge chamber 20 into the suction-side semicircular arc-shaped back pressure groove 28*a* of the side plate 5. This makes it possible to reduce the occurrence of the noise and vibration of the pump resulting from the collision of back pressure oil.

Further, the back pressure grooves of the side plate 5 are halves of back pressure grooves (semicircular arc-shaped back pressure grooves 28*a* and 28*b*) obtained by dividing the annular back pressure groove into the pump suction side groove and the pump discharge side groove. Due to this, it is possible to easily form the back pressure grooves of the side plate 5 which grooves are divided back pressure grooves obtained by dividing an annular back pressure groove into a pump suction side groove and a pump discharge side groove, as the simplest structure.

Moreover, if the back pressure groove of the cover plate 3 is formed out of the C-shaped back pressure groove 29' as shown in FIG. 6, the volume of the pump chamber decreases an the vanes 14 are pressed by the cam ring 7 to thereby reduce the ejection rate of the vanes 14 at the pump discharge side. Thus, the back pressure oil forced out of the discharge-side semicircular arc-shaped back pressure groove 28 of the side plate 5, the pump discharge-side back pressure hole 16 of the rotor 8 and the discharge-side back pressure groove of the cover plate 3 (the lower half of the C-shaped back pressure groove 29'), is inducted to flow into the suction-side back pressure groove (the upper half of the C-shaped back pressure groove 29) of the cover plate 3 communicating, in a C-shaped manner, with the discharge-side back pressure groove (the lower half of the C-shaped back pressure groove 29') of the cover plate 3 and further into the pump suction-side back pressure hole 16 of the rotor 8. As a result, the back pressure oil flows into the back pressure hole 16 of the rotor 18 by way of a long path circulating the continuous portion of the C-shaped groove, i.e., from one end side of the C shaped back pressure groove to the other end side thereof. During that moment, back pressure oil flow energy is offset by the flow friction loss, thereby making it possible to reduce the occurrence of the noise and vibration of the pump accordingly.

Additionally, at the pump discharge side, the back pressure oil forced out of the discharge-side semicircular arc-shaped back pressure groove 28*b* of the side plate 5, the pump discharge-side back pressure hole 16 of the rotor 8 and the discharge-side back pressure groove (the lower half of the C-shaped back pressure groove 29') of the cover plate 3, is induced to go through a long path circulating the C-shaped continuous portion of the C-shaped back pressure groove 29' of the cover plate 3 and to flow into the pump suction-side back pressure hole 16 of the rotor 8, as already described above. Since the flow direction of the back pressure is opposite to the rotation direction of the rotor 8, back pressure oil flow energy is effectively offset by the friction loss between the back pressure oil of the rotor 8, thereby making it possible to further reduce the occurrence of the noise and vibration of the pump accordingly.

As heretofore explained, embodiments of the present invention have been described in detail with reference to the drawings. However, the specific configurations of the present invention are not limited to the embodiments but those having a modification of the design within the range of the present invention are also included in the present invention.

As stated so far, the invention is a back pressure groove structure of a variable displacement vane pump comprising a rotor rotatably contained in a pump housing and having a plurality of vane grooves arranged radially and equidistantly in a circumferential direction. A cam ring is arranged in the pump housing in a movable and displaceable manner, fitted into the pump housing to form a pump chamber with an outer peripheral portion of the rotor and applied with an urging force to provide a maximum volume of the pump chamber. A side plate is contained in the pump housing in a non-rotatable manner, slidably contacting with one side of the rotor and the cam ring and having back pressure grooves communicating with the vane grooves. A cover plate closes an opening of the pump housing, slidably contacting with the other side of the rotor and the cam ring and having a back pressure groove communicating with the vane grooves, and characterized in that the back pressure grooves of the side plate communicate with a high pressure side and are divided back pressure grooves obtained by dividing annular back pressure grooves into a pump suction side groove and a pump discharge side groove. The back pressure groove of the cover plate is an annular back pressure groove.

In the invention as stated above, the back pressure groove structure of the variable displacement vane pump comprising the rotor, the cam ring, the side plate and the cover plate is constructed such that the back pressure grooves of the side plate communicate with a high pressure side and are divided back pressure grooves obtained by dividing the annular back pressure grooves into a pump suction side and a pump discharge side and that the back pressure groove of the cover plate is an annular back pressure groove.

As a result, at the pump discharge side, as the volume of the pump chamber decreases, the vanes are pressed by the cam ring and the ejection rate of the vanes decreases. Thus, the back pressure oil forced out of the discharge-side semicircular arc-shaped back pressure groove of the side plate, the pump discharge-side back pressure hole of the rotor and the discharge-side back pressure groove of the cover plate, is induced to flow into the suction-side back pressure groove of the cover plate annularly communicating with the suction-side back pressure groove file cover plate and further into the pump suction-side back pressure hole of the rotor. Thus, this back pressure oil is attracted by the cam ring as a result of the increased volume of the pump chamber and the ejection rate of the vanes increases at the pump suction side, whereby the back pressure oil does not collide against the back pressure oil fed from the high pressure chamber (pump discharge chamber) into the suction-side semicircular arc-shaped back pressure groove of the side plate. This makes it possible to reduce the occurrence of the noise and vibration of the pump resulting from the collision of back pressure oil.

The back pressure groove of the side plate may be halves of back pressure grooves obtained by dividing the annular back pressure groove into the pump suction side groove and the pump discharge side groove.

As a result, it is possible to easily form the back pressure grooves of the side plate which grooves are divided back pressure grooves obtained by dividing an annular back pressure groove into a pump suction side groove and a pump discharge side groove, as the simplest structure.

The back pressure groove of the cover plate may be a C-shaped back pressure groove obtained by closing the annular back pressure groove at one of a pump suction side portion and a pump discharge side portion, the annular back pressure groove virtually partitioned into the pump suction side portion and the pump discharge side portion.

As a result, the volume of the pump chamber decreases and the vanes are pressed by the cam ring to thereby reduce the ejection rate of the vanes at the pump discharge side. Thus, the back pressure oil forced out of the discharge-side semicircular arc-shaped back pressure groove of the side plate, the pump discharge-side back pressure hole of the rotor and the discharge-side back pressure groove of the cover plate, is inducted to flow into the suction-side back pressure groove of the cover plate communicating, in a C-shaped manner, with the discharge-side back pressure groove of the cover plate and further into the pump suction-side back pressure hole of the rotor. Consequently, the back pressure oil flows into the back pressure hole of the rotor by way of a long path circulating the continuous portion of the C-shaped groove, ie., from one end side of the C shaped back pressure groove to the other end side thereof. During that moment, back pressure oil flow energy is offset by the flow friction loss, thereby making it possible to reduce the occurrence of the noise and vibration of pump accordingly.

The one portion may be at a side which a pump discharge step is completed and a pump suction step is started.

As a result, the back pressure oil forced out of the discharge-side semicircular arc-shaped back pressure groove of the side plate, the pump discharge-side back pressure hole of the rotor and the discharge-side back pressure groove of the cover plate, is induced to go through a long path circulating the C-shaped continuous portion of the C-shaped back pressure groove of the cover plate from on end side of the C-shaped portion of the back pressure groove (C-shaped back pressure groove) of cover plate to the other end side thereof and to flow into the pump suction-side back pressure hole of the rotor. Since the flow direction of the back pressure is opposite to the rotation direction of the rotor, back pressure oil flow energy is effectively offset by the friction loss between the back pressure oil and the rotor, thereby making it possible to further reduce the occurrence of noise and vibration of the pump accordingly.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A back pressure groove structure of a variable displacement vane pump comprising:

a rotor rotatably contained in a pump housing and having a plurality of vane grooves arranged radially and equidistantly in a circumferential direction; the rotor rotatable through a suction side and a discharge side of the pump housing;

a cam ring arranged in said pump housing in a movable and displaceable manner, fitted into the pump housing to form a pump chamber with an outer peripheral portion of said rotor and applied with an urging force to provide a maximum volume of said pump chamber;

a side plate contained in said pump housing in a non-rotatable manner, slidably contacting with one side of said rotor and said cam ring and having back pressure grooves communicating with said vane grooves; and a cover plate closing an opening of said pump housing, slidably contacting with other sides of said rotor and said cam ring and having a cover plate back pressure groove communicating with said vane grooves, wherein the back pressure grooves of said side plate are divided back pressure grooves divided into a pump suction side groove in communication with a high pressure side and a pump discharge side groove; and the back pressure groove of said cover plate is one of an annular and a C-shaped back pressure groove;

the pump discharge side groove in communication via the vane grooves in the discharge side, the cover plate back pressure groove, and the vane grooves in the suction side with the pump suction side groove.

2. A back pressure groove structure of a variable displacement vane pump according to claim 1, wherein the back pressure groove of said cover plate is a C-shaped back pressure groove obtained by closing the annular back pressure groove at one of a pump suction side portion and a pump discharge side portion, the annular back pressure groove virtually partitioned into the pump suction side portion and the pump discharge side portion.

3. A back pressure groove structure of a variable displacement vane pump according to claim 2 wherein said one portion is at a side at which a pump discharge step is completed and a pump suction step is started.

* * * * *